US007335847B2

(12) United States Patent
Drewes et al.

(10) Patent No.: US 7,335,847 B2
(45) Date of Patent: Feb. 26, 2008

(54) METHOD AND APPARATUS FOR FOREIGN-BODY SEPARATION FROM A MATERIAL FLOW

(75) Inventors: Harry Drewes, Hamburg (DE); Frank Schuster, Hamburg (DE)

(73) Assignee: HAUNI Primary GmbH, Hamburg (DE)

( * ) Notice: Subject to any disclaimer, the term of this patent is extended or adjusted under 35 U.S.C. 154(b) by 115 days.

(21) Appl. No.: 11/103,518

(22) Filed: Apr. 12, 2005

(65) Prior Publication Data

US 2005/0236306 A1 Oct. 27, 2005

(30) Foreign Application Priority Data

Apr. 27, 2004 (DE) ..... 10 2004 020 776

(51) Int. Cl.
*B07C 5/00* (2006.01)
*A24B 7/14* (2006.01)

(52) U.S. Cl. ..... 209/587; 209/639; 209/644; 209/44.1; 209/44.2; 209/576; 209/577; 209/139.1; 131/110; 131/109.3; 131/312

(58) Field of Classification Search ..... 131/110, 131/109.2, 312; 209/639, 644, 44.1, 44.2
See application file for complete search history.

(56) References Cited

U.S. PATENT DOCUMENTS 2,771,079 A 11/1956 Umney
3,096,276 A * 7/1963 Franks et al. ..... 209/20
3,265,209 A 8/1966 Wochnowski et al.
3,265,210 A 8/1966 Harte et al.
5,073,252 A * 12/1991 Ouig ..... 209/139.1
5,462,176 A * 10/1995 Hereford et al. ..... 209/577
5,699,724 A 12/1997 Wettstein et al.
5,791,489 A * 8/1998 Leifeld ..... 209/44.1
6,059,117 A * 5/2000 Novak et al. ..... 209/10
6,332,543 B1 12/2001 Niehues et al.
6,435,191 B1 8/2002 Roudabush et al.
6,646,218 B1 * 11/2003 Campbell et al. ..... 209/582
6,771,365 B1 * 8/2004 Pirani et al. ..... 356/238.2
6,994,218 B2 * 2/2006 Kawano et al. ..... 209/210

(Continued)

FOREIGN PATENT DOCUMENTS

DE 1152340 8/1963

(Continued)

*Primary Examiner*—Patrick Mackey
*Assistant Examiner*—Terrell Matthews
(74) *Attorney, Agent, or Firm*—Greenblum & Bernstein, P.L.C.

(57) ABSTRACT

Method and apparatus for the separation of foreign bodies from a material flow, in particular a tobacco stream. Method is characterized in that at least a portion of the material from the material flow is conveyed into the area of a foreign-body detection device in the form of a partial material flow, whereby foreign bodies are identified by the foreign-body detection device in the partial material flow and subsequently removed from the partial material flow, whereby the partial material flow is formed by a separation step by an air flow upstream from the foreign-body detection device. Apparatus is characterized in that a material flow conveyor and a separation device arranged diagonal to the material flow conveyor are provided by which a partial material flow can be separated from the material flow. A foreign-body detection device is arranged after the separation device and after this, a foreign-body separation device.

15 Claims, 3 Drawing Sheets

U.S. PATENT DOCUMENTS

| | | | | |
|---|---|---|---|---|
| 2002/0130067 | A1 | 9/2002 | Takai et al. | |
| 2003/0034040 | A1 | 2/2003 | Barkmann et al. | |
| 2003/0056306 | A1 | 3/2003 | Loth | |
| 2004/0040564 | A1 | 3/2004 | Kuhl et al. | |
| 2004/0216755 | A1 | 11/2004 | Schroder | |
| 2005/0199252 | A1* | 9/2005 | Coleman | 131/110 |
| 2005/0211256 | A1* | 9/2005 | Funke et al. | 131/109.2 |
| 2005/0211257 | A1* | 9/2005 | Funke et al. | 131/109.2 |
| 2005/0236306 | A1* | 10/2005 | Drewes et al. | 209/644 |

FOREIGN PATENT DOCUMENTS

| | | |
|---|---|---|
| DE | 2609812 | 9/1977 |
| DE | 4030344 | 4/1992 |
| DE | 4322345 | 3/1994 |
| DE | 4320362 | 12/1994 |
| DE | 19537846 | 11/1996 |
| DE | 19531057 | 4/1997 |
| DE | 19642736 | 4/1997 |
| DE | 19840143 | 3/2000 |
| DE | 10146512 | 10/2002 |
| DE | 10154807 | 5/2003 |
| EP | 0824607 | 2/1998 |
| EP | 1208919 | 5/2002 |
| WO | 03/048747 | 6/2003 |

* cited by examiner

METHOD AND APPARATUS FOR FOREIGN-BODY SEPARATION FROM A MATERIAL FLOW

CROSS-REFERENCE TO RELATED APPLICATIONS

The present application claims priority under 35 U.S.C. §119 of German Patent Application No. 10 2004 020 776.3-27 filed on Apr. 27, 2004. The disclosures of the foregoing application and each U.S. and foreign patent and patent application mentioned herein are incorporated herein by reference.

BACKGROUND OF THE INVENTION

1. Field of the Invention

The invention relates to a method and an apparatus for the separation of foreign bodies from a material flow, in particular a tobacco stream.

2. Discussion of Background Information

An apparatus is known from U.S. Pat. No. 6,332,543 B1 in which a tobacco, stream is brought into the area of an optical foreign-body detection device by means of conveyors, in particular a trough conveyor and conveyor belts. As soon as a foreign body is identified in the tobacco stream by means of the foreign-body detection device, the foreign body or foreign bodies are removed from the tobacco stream by means of compressed air diagonal to the conveying direction.

SUMMARY OF THE INVENTION

The invention provides an additional version of a method and an apparatus for foreign-body separation from a material flow.

According to the invention, a method is provided for the separation of foreign bodies from a material flow, in particular a tobacco stream, whereby at least a portion of the material from the material flow is conveyed into the area of a foreign-body detection device in the form of a partial material flow, whereby foreign bodies are identified by means of the foreign-body detection device in the partial material flow, in particular based on at least one characteristic, and subsequently removed from the partial material flow, whereby the partial material flow is formed by a separation step by means of an air flow upstream from the foreign-body detection device.

Through the method according to the invention, a very efficient foreign-body separation is possible from a material flow. A separation step, especially a sifting step, is to be understood, in particular, as the release or separation of a fraction or a portion of the material from the material flow, which offers sufficient air resistance and is sufficiently light, in order to be able to be released from the material flow in the case of a specified or specifiable air-flow speed and in order to be able to be removed from it. The material is preferably separated, Within the framework of the invention, upstream should be understood in particular in terms of the conveying direction of the partial material flow. The foreign bodies are identified based on at least one property, such as the luminosity, the color, the moistness, or dielectric properties, to name only a few.

If the speed of the air flow is or will be increased at least in the area of the foreign-body detection device, the foreign-body detection rate is improved.

If the partial material flow is conveyed in a channel, a defined conveyance of the partial material flow with a defined speed is possible so that foreign bodies can be separated in a highly efficient manner from the partial material flow after identification. The channel preferably has a closed or basically closed cross-section. An increase in the speed of the air flow is especially efficient and thus easy to implement if the channel has a decreasing cross-sectional area at least in sections, in particular in the area of the foreign-body detection device. If the partial material flow is conveyed curved at least in sections in the area of the foreign-body detection device, it is easy to create a partial material flow that has a low depth, whereby in particular an optical detection device can be very efficiently operated. The partial material flow is preferably conveyed at least in sections in an S curve.

If the partial material flow is diverted at least in sections in particular in the area of the foreign-body detection device by another air flow, window materials or inner walls of the channel can be conserved. For this, the partial material flow is conveyed past in particular the window, which is preferably designed as an inspection window for the foreign-body detection device. It is hereby avoided that the window is exposed to the abrasive effect of the material flow.

According to the invention, an apparatus is provided for foreign-body separation from a material flow, in particular a tobacco stream, whereby a material-flow conveyor and a separation device, in particular a sifting device, arranged diagonal to the material-flow conveyor are provided, by means of which a partial material flow can be separated from the material flow, whereby a foreign-body detection device is arranged after the separation device and after this, a foreign-body separation device.

Through the apparatus according to the invention, a very efficient foreign-body separation is possible from a material flow, The separation device preferably comprises a channel. This measure provides an efficient conveyance of the partial material flow. If the channel extends into the area of the foreign-body detection device, a very exact determination or detection of foreign bodies is possible. By extending the channel into the area of the foreign-body detection device, it is understood in particular that the channel extends past the foreign-body detection device in the area of the foreign-body detection. The channel is preferably followed by a suction channel. Through this measure, a defined speed of the partial material flow can be reached, so that the foreign-body separation efficiency is increased. The channel and the suction channel can be adjoined or can also be a single device or a single element. The suction channel can also extend into the area of the detection of foreign bodies. The channel can comprise the suction channel or be it.

If at least one of the channel and the suction channel has a reduced cross-sectional area at least in sections, the speed of the partial material flow there is uniform and defined, so that an improved foreign-body detection and foreign-body separation is enabled, because the partial material flow is basically arranged evenly. Within the framework of the invention, the reduced cross-sectional surface is to be understood in particular in relation to the cross-sectional area on the inlet side of the sifting channel or channel. The speed of the partial material flow increases by reducing the cross-sectional area.

If at least one of the channel and the suction channel is designed curved at least in sections, a particularly good foreign-body detection is possible. The foreign-body detection is further improved in that at least one of the channel and the suction channel is designed in an S-shaped manner at least in sections. A particularly simple implementation of a foreign-body detection device is then provided if at least one window is provided in at least one of the channel and the suction channel in the area of the foreign-body detection device. If a side channel is provided that enables an air flow in the interior of the channel and/or the suction channel along at least one window, the window is guaranteed a long service life. Within the framework of the invention, the term side channel also includes the term air nozzle.

Other exemplary embodiments and advantages of the present invention may be ascertained by reviewing the present disclosure and accompanying drawings.

BRIEF DESCRIPTION OF THE DRAWINGS

The present invention is further explained in the detailed description which follows with the aid of exemplary embodiments, but without limiting the general inventive idea, in reference to the drawings, in which like reference numerals represent similar parts throughout the several views of the drawings.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In the figures the same or similar elements or corresponding parts are respectively provided with the same reference numbers, so that a corresponding renewed introduction is unnecessary and only deviations of the exemplary embodiments in these figures from the first exemplary embodiment are explained.

Figure 1:
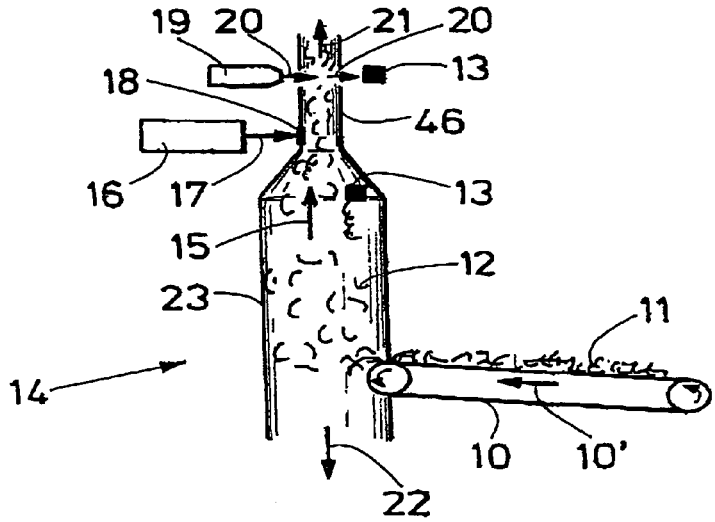
FIG. 1 illustrates a schematic cross-sectional representation of an apparatus according to the invention.

FIG. 1 shows a schematic cross-sectional representation of an apparatus according to the invention for foreign-body separation from a tobacco stream 11. The tobacco stream 11 is applied to a conveyor belt 10. The tobacco stream 11 is conveyed in the conveying direction 10' on the conveyor belt 10.

By means of an air-flow creation device, such as a pump in the lower and/or upper area of the channel 23 or suction channel 46, which sucks the air out of a channel 23 or a suction channel 46 and/or blows it into a channel 23, an air flow 21 is created that enables the separation, especially the sifting, of the tobacco stream 11 entering the channel 23. The speed of the air flow can be between 2 m/s and 30 m/s (preferably between 5 m/s and 17 m/s). Through a correspondingly adjustable or specifiable speed of the air flow 21, components of the tobacco stream 11 in the form of tobacco 12 and foreign bodies 13, which are sufficiently light or have a sufficiently high air resistance in order to be transported upwards against the force of gravity out of the tobacco stream 11 in FIG. 1, are conveyed upwards in the channel 23. A partial tobacco stream 15 is thus created that also comprises foreign bodies 13. The separation device, especially sifting device, is indicated by reference number 14. Components 22 that are too heavy, such as ribs or stones, end up at the bottom, as indicated by the arrow.

The partial tobacco stream 15 ends up in the area of a foreign-body detection device 16, which is an optical foreign-body detection device in this exemplary embodiment, for example, one that comprises a laser and sends a light beam 17 through a window 18 into the channel 23 and absorbs the reflected light by means of a light-sensitive detector, a CCD (charge coupled device), photo-multiplexer, or a camera and correspondingly compares it with specifiable values, such as luminosity amplitudes or color amplitudes. Foreign bodies can correspondingly be identified hereby. At a defined or basically defined speed of the partial tobacco stream 15 depending on the distance between the foreign-body detection device 16 or the window 18 and a nozzle 19, an identified foreign body 13 can be separated from the partial tobacco stream 15 through an air flow 20 discharged from the nozzle 19 after the appropriate elapse of a determinable period of time.

The conveyor belt 10 in the exemplary embodiment is designed in accordance with FIG. 1, in order to extend to channel 23. The fraction of the tobacco stream 11, in the form of heavy components 22 like tobacco ribs, that was not separated ends up on a conveyor belt (not shown) below the separation device for further processing.

Figure 2:
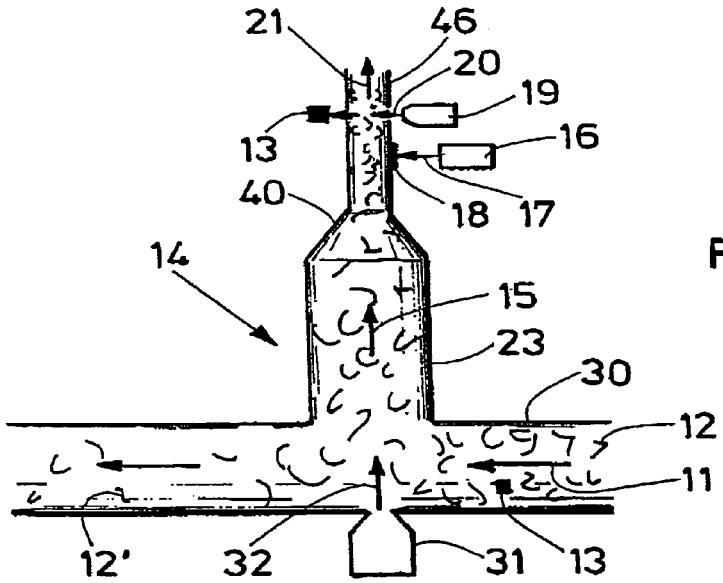
FIG. 2 illustrates a schematic cross-sectional representation of another embodiment of an apparatus according to the invention.

FIG. 2 also shows a schematic cross-sectional representation of another exemplary embodiment of an apparatus for foreign-body separation according to the invention. Unlike the exemplary embodiment in accordance with FIG. 1, the conveying element of the tobacco stream 11 is a conveying channel 30, into which the tobacco 12 and the foreign bodies 13 are conveyed by means of compressed air or an air flow. Also shown is a nozzle 31, which creates an air flow 32, which enables the separation. Moreover, unlike the exemplary embodiment in FIG. 1, the cross-section of the channel 23 in the area of the foreign-body detection, i.e. in particular in the area of the window 18, becomes smaller, so that the speed of the partial tobacco stream 15 is higher there than on the inlet side of the separation device 14. This is enabled through a tapering section 40 of the channel 23. Due to the increased speed, for one, the tobacco and foreign-body components of the partial tobacco stream 15 are dispersed, and, due to the tapering, the partial tobacco stream is also pushed together or compacted in depth, so that overall increased foreign-body detection efficiency. is provided. The material that was not sifted into the partial stream 15, such as heavy tobacco 12', for example ribs, is conveyed to the left in the conveying channel 30 for further processing.

Figure 3:
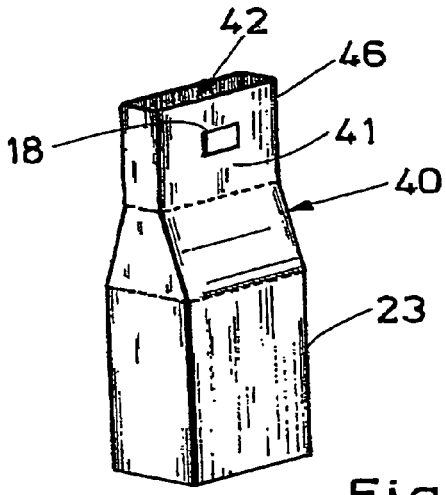
FIG. 3 illustrates a schematic three-dimensional representation of a part of an apparatus according to the invention.

FIG. 3 shows a schematic three-dimensional representation of a part of an apparatus for foreign-body separation according to the invention, whereby the channel 23 is shown with an attached suction channel 46. A tapering section 40 is also shown and a section 41 with decreased cross-sectional area 42. This section 41 with decreased cross-sectional area 42 shows the inspection window for the foreign-body detection device 16.

Instead of an optical foreign-body detection device, a foreign-body detection device based on physical parameters other than optics, such as microwaves or ultrasound, can be used in each exemplary embodiment of this application. Instead of the employed nozzle 19 for foreign-body separation, corresponding flaps can also be used.

Figure 4:
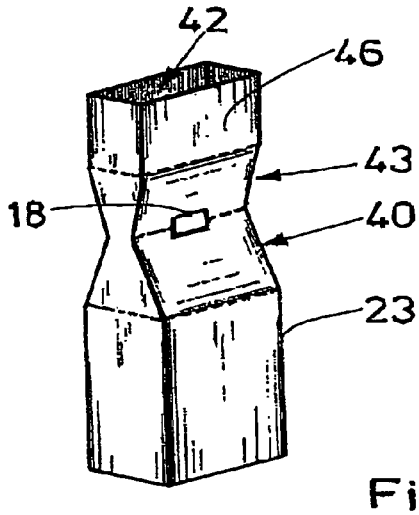
FIG. 4 illustrates a schematic three-dimensional representation of a part of an apparatus according to the invention.
Figure 5:
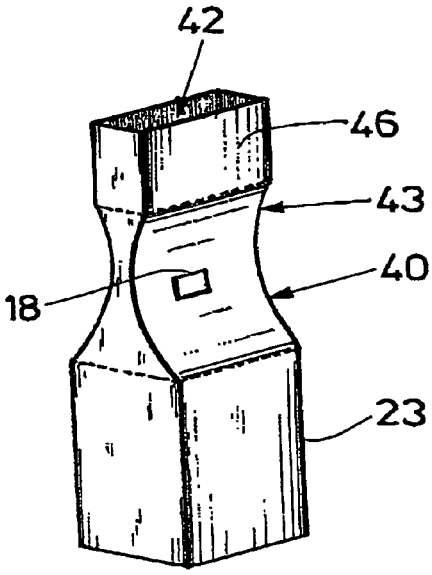
FIG. 5 illustrates a schematic three-dimensional representation of a part of an apparatus according to the invention.

FIG. 4 shows another exemplary embodiment of a channel 23 in a schematic three-dimensional representation, whereby suction channel 46 connects to the channel 23. The channel 23 can also comprise the suction channel 46, so that it is a one-piece element. Compared to FIG. 3, a section of the channel 23 or a section of the suction channel 46 is also shown that is labeled as increasing section 43. The desired and specifiable average speed of the partial tobacco stream 15 and the speed distribution of the tobacco 12 and the foreign bodies 13 in the partial tobacco stream 15 can be optimized through this embodiment. The same applies in the exemplary embodiment in accordance with FIG. 5, in which the tapering section 40 and the increasing section 43 merge harmoniously. The mathematical derivative of the edge functions of the channel 23 or the suction channel 46 is constant in sections in this exemplary embodiment.

Figure 6:
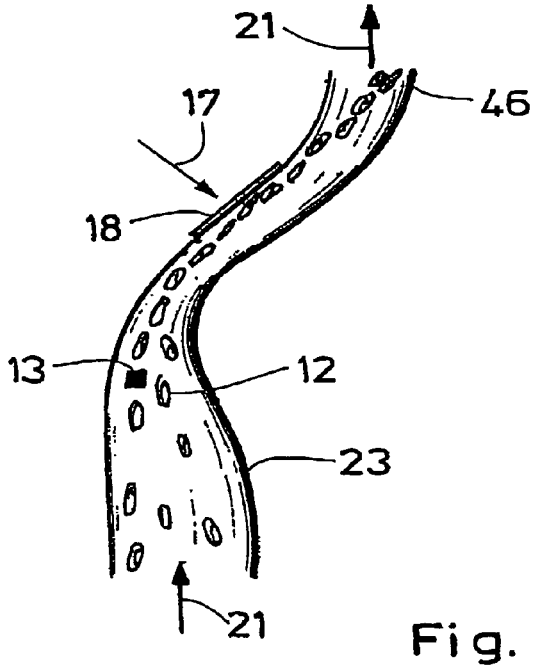
FIG. 6 illustrates a schematic cross-sectional representation of a channel of an apparatus according to the invention.

FIG. 6 shows a suction channel 46 or a channel 23 in a schematic cross-sectional representation, whereby this channel is curved. A one-sided abutting or sweeping past of the product stream or partial tobacco stream 15 on the wall is achieved in this exemplary embodiment. The height variation or depth variation is hereby greatly decreased, so that improved foreign-body detection efficiency is enabled.

Figure 7:
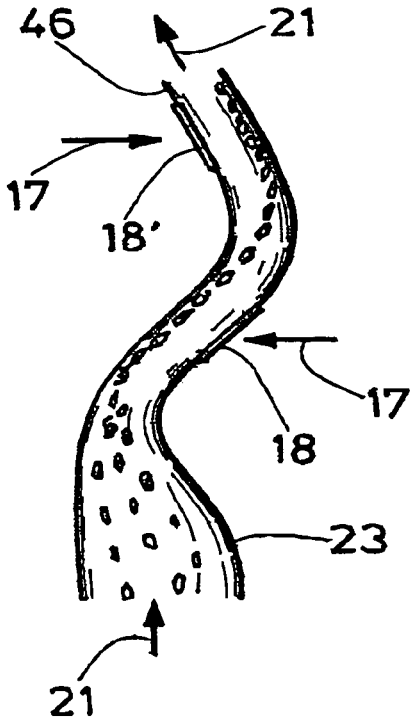
FIG. 7 illustrates a schematic cross-sectional representation of another channel of an apparatus according to the invention.

FIG. 7 shows a shaping of the channel 23 or 46 with varying curvature or with an S curve and varying abutting of the partial tobacco stream or the tobacco and the foreign bodies first on one and then on the opposite-lying wall. This enables consecutive observation of the product from both sides via two windows 18 and thus improved foreign-body detection.

Figure 8:
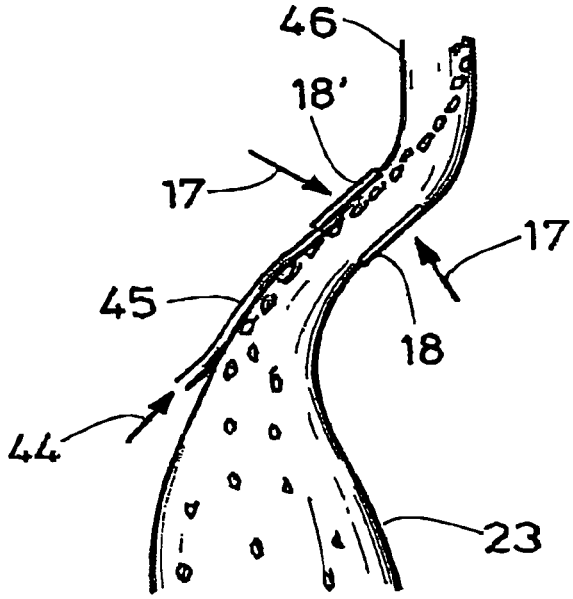
FIG. 8 illustrates a schematic cross-sectional representation of another channel of an apparatus according to the invention.

FIG. 8 shows another embodiment of the channel 23 or the suction channel 46 that also enables double-sided observation. In this exemplary embodiment, the partial tobacco stream 15 or the tobacco 12 and the foreign bodies 13 fly very closely past one of the two windows 18, 18', window 18' in this case, with low height variation, while it can be observed simultaneously through the opposite-lying window 18. A scratching of the window that lies closely adjacent to the tobacco stream 15 can be avoided through an additional air flow 44, which is directed past the window 18' by a nozzle or by a side channel 45. This is a type of air knife principle.

It makes sense for foreign-body detection with an optical detection device and the subsequent separation of the foreign bodies from the tobacco stream or the partial tobacco stream to disperse the partial tobacco stream so that a camera or a laser scan or an optical foreign-body detection device has a clear view or access to the tobacco surface or to the partial tobacco stream surface. For this, the creation of a mono-layered or basically mono-layered partial tobacco stream is practical. In order to achieve a good discharge rate, the quality of the product presentation is as important as the technology of the image processing. A separation of the product or material and foreign-body components makes sense here. It is also practical to observe the material flow from both sides, in order to prevent the covering of the foreign bodies by the material or to enable the detection of a covering. It also makes sense to achieve a low variation in height or depth in order to avoid depth of sharpness problems.

In order to also efficiently discharge the foreign bodies after the identification of a foreign body, it makes sense to achieve a uniform speed for the product and foreign-body components between the location of the detection and the location of the discharge. The smaller the speed distribution of the components of the material flow, the longer the distance between the detection location and the discharge location may be. Moreover, a high product flow, i.e. a high measure of material flow per time unit, is desired. This can be achieved via a broad width or a high product speed or partial-material flow speed or a combination of both.

Through the use of a separator or a separation device 14, especially a sifter or a sifting device, it is possible to achieve a particularly good separation of the material from the material flow and in particular of tobacco from a tobacco stream. In order to achieve the most uniform possible speed of the tobacco parts and the foreign bodies, it makes sense to let the speed of the air flow transporting the material increase or to accelerate the separated material. A particularly suitable position for the dispersion of the material is immediately after the separation device or after the separation. A unification of the air-flow speed and thus the speed of the components of the partial tobacco flow can be achieved through the narrowing of the cross-section or the cross-sectional area of the channel 23 or the suction channel 46. Moreover, a suitable shaping as listed above is preferred. The height variation or depth variation is decreased through the curvature of the suction channel 46 or the channel 23 at least in the area of the detection device.

The invention enables a very efficient foreign-body detection and separation, whereby little material is separated from the material flow.

It is noted that the foregoing examples have been provided merely for the purpose of explanation and are in no way to be construed as limiting of the present invention. While the present invention has been described with reference to an exemplary embodiment, it is understood that the words of which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means materials and embodiments, the present invention is not intended to be limited to the particulars disclosed herein; rather, the present invention extends to all functionally equivalent structures, methods and uses, such as are within the scope of the appended claims.

List of Reference Numbers

| | |
|---|---|
| 10 | Conveyor belt |
| 10' | Conveying direction |
| 11 | Tobacco stream |
| 12, 12' | Tobacco |

-continued

| List of Reference Numbers | |
|---|---|
| 13 | Foreign body |
| 14 | Separation device |
| 15 | Partial tobacco stream |
| 16 | Foreign-body detection device |
| 17 | Light beam |
| 18, 18' | Window |
| 19 | Nozzle |
| 20 | Air flow |
| 21 | Air flow |
| 22 | Heavy parts |
| 23 | Channel |
| 30 | Conveying channel |
| 31 | Nozzle |
| 32 | Air flow |
| 40 | Tapered section |
| 41 | Section with decreased cross-section area |
| 42 | Cross-sectional area |
| 43 | Increasing section |
| 44 | Air flow |
| 45 | Side channel |
| 46 | Suction channel |

What is claimed:

1. A method for separation of foreign bodies from a material flow, comprising:

transporting the material flow a material flow conveyor;

separating a partial material flow from the material flow with a separation device arranged at an angle to the material flow conveyor;

detecting a foreign-body with a detection device arranged after the separation device, wherein the separation device comprises a channel and at least one window positioned in an area of the foreign-body detection device;

removing the foreign body with a foreign-body separation device following the foreign-body detection device; and guiding through a side channel an air flow into an interior of the channel and along the at least one window.

2. The method according to claim 1, wherein the channel has a decreasing cross-sectional area at least in the area of the foreign-body detection device.

3. The method according to claim 1, wherein a separation air flow in the separation device separates the partial material flow from the material flow, and the separation air flow speed is increased at least in the area of the foreign-body detection device.

4. The method according to claim 1, wherein the air flow from the side channel diverts the partial material flow at least in the area of the foreign-body detection device.

5. The method according to claim 1, wherein the partial material flow is conveyed along a curved path at least in the area of the foreign-body detection device.

6. The method according to claim 5, wherein the partial material flow is conveyed at least in sections in an S curve.

7. The method according to claim 1, wherein the material flow comprises a tobacco stream.

8. An apparatus for the separation of foreign bodies from a material flow, comprising:

a material flow conveyor;

a separation device, arranged at an angle to the material flow conveyor, to separate a partial material flow from the material flow;

a foreign-body detection device arranged after the separation device and followed by a foreign-body separation device, wherein the separation device comprises a channel and at least one window positioned in an area of the foreign-body detection device; and a side channel structured and arranged to allow an air flow into an interior of the channel and along the at least one window.

9. The apparatus according to claim 8, wherein the channel has a decreasing cross-sectional area at least in the area of the foreign-body detection device.

10. The apparatus according to claim 8, wherein the separation device further comprises a suction channel arranged to follow the channel, relative to a material flow direction.

11. The apparatus according to claim 10, wherein at least one of the channel and the suction channel is designed curved at least in sections.

12. The apparatus according to claim 10, wherein at least one of the channel and the suction channel is S-shaped at least in sections.

13. The apparatus according to claim 10, wherein the at least one window positioned in the area of the foreign-body detection device is located in at least one of the channel and the suction channel.

14. The apparatus according to claim 8, wherein a separation air flow in the separation device is guided to separate the partial material flow from the material flow, and a separation air flow speed outside of the area of the foreign-body detection device is between 2 m/s and 30 m/s.

15. The apparatus according to claim 8, wherein the material flow comprises a tobacco stream.

* * * * *

UNITED STATES PATENT AND TRADEMARK OFFICE

CERTIFICATE OF CORRECTION

PATENT NO. : 7,335,847 B2
APPLICATION NO. : 11/103518
DATED : February 26, 2008
INVENTOR(S) : Drewes et al.

It is certified that error appears in the above-identified patent and that said Letters Patent is hereby corrected as shown below:

At column 7, line 28 (claim 1 line 3) of the printed patent, "flow a material" should be --flow by a material--.

Signed and Sealed this

First Day of July, 2008

JON W. DUDAS
*Director of the United States Patent and Trademark Office*